US006397750B1

(12) United States Patent
Motoe et al.

(10) Patent No.: US 6,397,750 B1
(45) Date of Patent: Jun. 4, 2002

(54) STENCIL DISPOSAL UNIT AND STENCIL DISPOSAL METHOD

(75) Inventors: Katsuro Motoe; Shigenori Ishii, both of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/620,212

(22) Filed: Jul. 20, 2000

(30) Foreign Application Priority Data

Jul. 23, 1999 (JP) ..... 11-209339

(51) Int. Cl.[7] ..... B41L 47/14
(52) U.S. Cl. ..... 101/477; 101/116
(58) Field of Search ..... 101/114, 116, 101/389.1, 409, 410, 415.1, 477, 479, 480

(56) References Cited

U.S. PATENT DOCUMENTS 5,323,699 A * 6/1994 Motoe et al. ..... 101/114
5,560,299 A * 10/1996 Takahira ..... 101/389.1
5,619,917 A * 4/1997 Takahira ..... 101/116
5,623,871 A * 4/1997 Takahira ..... 101/114
5,713,274 A * 2/1998 Kawai et al. ..... 101/114
5,988,061 A * 11/1999 Kagawa ..... 101/128.4
6,186,062 B1 * 2/2001 Ohno ..... 101/116

FOREIGN PATENT DOCUMENTS

EP 0 714 783 A2 6/1996

* cited by examiner

*Primary Examiner*—Ren Yan
(74) *Attorney, Agent, or Firm*—Nath & Associates; Gary M. Nath; Marvin C. Berkowitz

(57) ABSTRACT

In a stencil disposal unit and stencil disposal method for disposing a stencil clamped at and wound on a printing drum of a rotary stencil printing machine, the end part of the stencil sheet from a clamp is released, the printing drum is caused to rotate in a winding direction with respect to the end part of the stencil sheet released from the clamp, so as to guide the end part of the stencil sheet to a pull-in position, and the printing drum is caused to rotate in a reverse direction opposite to the winding direction, as pulling in the end part of the stencil sheet.

9 Claims, 11 Drawing Sheets

STENCIL DISPOSAL UNIT AND STENCIL DISPOSAL METHOD

BACKGROUND OF THE INVENTION

The present invention relates to a stencil disposal unit and stencil disposal method, and more particularly to a stencil disposal unit and stencil disposal method in which a used stencil wound around the outer periphery of a printing drum of a rotary stencil printing machine is transported to a stencil disposal container or the like and then disposed.

Upon an investigation by the inventors of the present invention, a stencil disposal unit provided in a rotary stencil printing machine is envisioned, such as shown in FIG. 8, in which the stencil disposal unit 138 automatically disposes of a used stencil from a printing drum.

The stencil disposal unit 138 is disposed in proximity to the periphery of a printing drum 112, and minimally has a pair of stencil disposal rollers 139, which are in mutual contact and which rotate in mutually opposite directions. The stencil sheet M is fed in between the stencil disposal rollers 139 and transported and recovered in a stencil disposal container 140 to the rear thereof.

In this rotary stencil printing machine the prepared stencil sheet M is automatically fed to and wound around the printing drum 112.

Specifically, as shown in FIG. 8, after a stencil sheet M is pulled out from a stencil sheet roll and, and a stencil is made from the stencil sheet M using a thermal printing head 107, it is transported to the printing drum 112. After transport to the printing drum 112, the end part of the stencil sheet M is grabbed by the clamping plate 119 at the printing drum 112, and wound around the outer periphery of the printing drum 112 by rotation of the printing drum 112. When the fixing of the stencil sheet M to the printing drum 112 is completed, a cutter unit 111 cuts the stencil sheet M.

The stencil sheet M is formed by a thermoplastic resin film, such as a polyethylene terephthalate film, a vinylidene chloride film, a polyester film, or a polypropylene film or the like, to which an ink permeable porous sheet (porous tissue carrier), made of a natural fiber, a chemical fiber, a synthetic fiber, or a thin paper, non-woven cloth, silk gauze or the like that is a mixture thereof is adhered, thereby forming a thermally sensitive stencil sheet. For a rolled stencil sheet M such as shown in FIG. 8, the ink permeable porous sheet is disposed on the outside surface. When printing is done, the ink permeable porous sheet makes contact with the outer surface of the printing drum 112.

When printing, the printing drum 112 is caused to rotate in the counterclockwise direction as shown in FIG. 8, the print paper (not shown in the drawing) being fed between the printing drum 112 and a pressure means (not shown in the drawing), which presses the print paper up against the image part of the stencil sheet M attached to the printing drum 112. By doing this, ink fed by an ink feeding means (not shown in the drawing)within the printing drum 112 passes through an ink-permeable part on the outer wall of the printing drum 112, and is transferred to the print paper via the perforation parts of the stencil sheet M so as to form an image thereon.

When the printing is completed, the disposal operation is performed by the stencil disposal unit 138. When disposing the stencil sheet M, as shown in FIG. 9, a mechanism not shown in the drawing releases the grip of the clamping plate 119 on the stencil sheet M, thereby freeing up the end part of the stencil sheet M that had been held. The printing drum 112 is then caused to rotate in the counterclockwise direction shown in FIG. 8, so that the freed-up end part of the stencil sheet M is fed between the pair of stencil disposal rollers 139, causing disposal of the stencil sheet M.

SUMMARY OF THE INVENTION

According to an investigation by the inventors, however, with the stencil disposal unit 138, the freed-up end part of the stencil sheet M that had been held by the clamping plate 119 has a tendency to curl, as shown in FIG. 9.

If the stencil sheet M curls, this curl can cause the end to miss the space between the pair of stencil disposal rollers 139, so that it is not transported into the stencil disposal container 140. Additionally, because of the curving tendency of the rolled stencil sheet M, the expansion of the ink permeable porous sheet making up the stencil sheet M due to humidity in the air, and the influence of temperature and static electricity, the curl of the end part of the stencil sheet M often tends to be in a direction away from the printing drum 112. By the rotation of the printing drum 112 during stencil disposal, there is resistance that urges the curl to move further away from the printing drum 112, thereby aggravating the problem of curl.

For this reason, it can be envisioned that, in the stencil disposal unit 138, as shown in FIG. 11, an endless guide belt 145 is wound between a stencil disposal roller 139a, which, of the pair of stencil disposal rollers 139, is farther from the printing drum 112, and a pulley 146 is disposed above the clamping plate 119, so as to guide a curled end of the stencil sheet M to between the pair of stencil disposal rollers 139. If this is done, the guide belt 145 is rotationally driven by the rotation of the stencil disposal rollers 139.

Another arrangement that can be envisioned is, as shown in FIG. 11, to provide an air blower 160 that applies pressure to the printing drum 112 side of the end part of the stencil sheet M to be curled, the air flow from the air blower 160 guiding the end part of the stencil sheet M to between the pair of stencil disposal rollers 139.

It is also possible to combine elements of the guide belt 145 and the air blower 160.

However, as the investigation by the inventors progressed further it was understood that, in the configuration in which a guide belt 145 is provided in the stencil disposal unit 138, the position at which the guide belt 145 is provided is very close to the clamping plate 119, so that it interferes with the swinging range of the clamping plate 119.

For this reason, when the clamping plate 119 is caused to swing, it is necessary to have an added moving mechanism such that the pulley 146 onto which the guide belt 145 is wound is moved about the stencil disposal rollers 139 as a center, so that the guide belt 145 does not come into contact with the clamping plate 119.

While it can be envisioned that the stencil disposal unit 138 having the guide belt 145 be positioned at a distance from the clamping plate 119, thereby eliminating the need for the added moving mechanism, when the stencil disposal unit 138 is moved away from the clamping plate 119, because the angle through which the printing drum 112 is turned after the clamping plate 119 is released becomes larger, the rotation of the printing drum 112 as noted above results in a large resistance that urges the curl to move away from the printing drum 112, so that it is not possible to establish the position of the end part thereof, leading to the problem of missed disposal operation.

If an air blower 160 is used, although this does not involve the swinging range of the clamping plate 119, another moving mechanism for the motor required by the air blower 160 is still required. Additionally, making the air blower 160 itself small will reduce the air output, making it necessary to bring this device close to the clamping plate 119.

Thus, in the investigation conducted by the inventors as to the stencil disposal unit 138, it was understood that the adopting of a configuration for the purpose of preventing faulty disposal of a used stencil was limited in terms of the positional relationship with respect to the clamping plate 119, making it difficult to achieve a suitable configuration.

The printing drum 112 is configuration to enable removal in the axial direction for the purpose of maintenance inspections or the like. In this type of configuration, if the clamping plate 119 and the stencil disposal unit 138 are in mutual proximity, when the printing drum 112 is pulled out, there is a risk that contact by the printing drum 112 will cause the clamping plate 119 to come into contact with the guide belt 146, the air blower 160 or the like of the stencil disposal unit 138.

Accordingly, the present invention was made by the above mentioned studies and has an object to provide a stencil disposal unit and stencil disposal method that substantially omits a restriction on an arrangement of structural elements due to a configuration of a printing drum, occurrence of curl of a stencil sheet or the like, and also performs disposal operation of the stencil sheet in stable and with a simple structure not required an additional mechanism such as a movable mechanism.

In accordance with the present invention, a stencil disposal unit disposing a stencil sheet an end part of which is clamped at and wound onto a printing drum of a rotary stencil printing machine having a rotational drive mechanism capable of causing the printing drum to rotate in a winding direction with respect to an end part of a stencil sheet released from a clamp and in a reverse direction opposite to the winding direction, comprises: a pair of stencil disposal rollers arranged in an area around a periphery of the printing drum and rotatable respectively in opposite directions in mutual contact with each other, thereby pulling in the end part of the stencil sheet so as to transport the stencil sheet to a predetermined disposal position. Here, by rotating the printing drum through a predetermined angle in the winding direction, the end part of the stencil sheet is guided to a pull-in position at which the stencil sheet is to be pulled in, and the printing drum is rotated in the reverse direction, as the stencil sheet is pulled in at the pull-in position by the pair of disposal rollers.

Beside, in another aspect of the present invention, a stencil disposal method disposing a stencil sheet an end part of which is clamped at and wound around a printing drum of a rotary stencil printing machine, comprises: releasing the end part of the stencil sheet from a clamp; causing the printing drum to rotate in a winding direction with respect to the end part of the stencil sheet released from the clamp, so as to guide the end part of the stencil sheet to a pull-in position; and causing the printing drum to rotate in a reverse direction opposite to the winding direction, as pulling in the end part of the stencil sheet.

BRIEF DESCRIPTIONS OF THE DRAWINGS

DETAILED DESCRIPTION OF THE PREFERRED EMBODIMENT

An embodiment of a stencil disposal unit and stencil disposal method according to the present invention is described in detail below, with references being made to relevant accompanying drawings.

Figure 1:
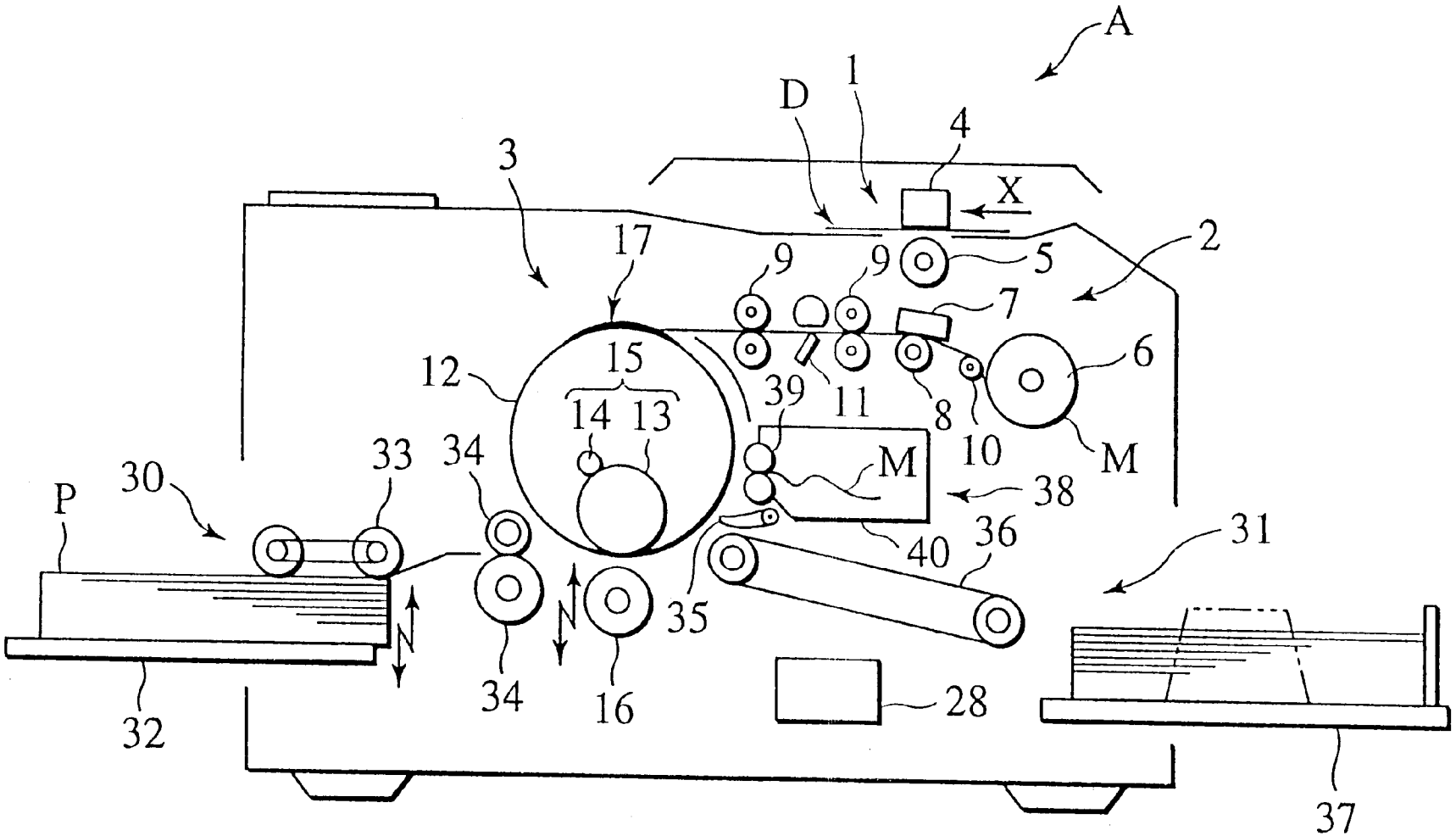
FIG. 1 is side view showing the schematic configuration of a rotary stencil printing machine to which a stencil disposal unit according to an embodiment of the present invention is applied.

As shown in FIG. 1, a rotary stencil printing machine A has an original reading section 1, a stencil making section 2, and a printing section 3, these being controlled by a controller 28.

The original reading section 1 is an image scanner, having a line image sensor 4 and an original feed roller 5 aligned in the main scan direction (vertical paper direction in FIG. 1) so as to perform reading of an image of an original D, which is transported in the sub-scanning direction.

The original is transported by the original feed roller 5 in the sub-scanning direction (the left direction indicated by the arrow X in the drawing), and the image of the original is read by the line image sensor 4. The original reading section 1 is not restricted to this configuration, and can alternately have a configuration in which the line image sensor is moved in the sub-scanning direction relative to a fixed original so as to read the image of the original.

Thus, the image of the original reading section 1 is read by the relative motion between the line image sensor 4 and the original.

The stencil making section 2 has a stencil sheet roll support 6, which support the rolled stencil sheet M, a thermal printing head 7, which is made of a plurality of heat sources aligned in a single row, original feed rollers 8 and 9, a stencil sheet guide roller 10, and a cutter unit 11.

The stencil sheet M is formed by a thermoplastic resin film, such as a polyethylene terephthalate film, a vinylidene chloride film, a polyester film, or a polypropylene film or the like, to which an ink permeable porous sheet (porous tissue carrier), made of a natural fiber, a chemical fiber, a synthetic fiber, or a thin paper, non-woven cloth, silk gauze or the like that is a mixture thereof is adhered, thereby forming a thermally sensitive stencil sheet. As shown in FIG. 1, the stencil sheet M is rolled, with the ink permeable porous sheet disposed on the outer surface of the roll.

At the stencil making section 2, a continuously rolled stencil sheet M is selectively heated individually by the plurality of heat sources of the thermal printing head 7, thereby performing a dot matrix type thermal perforation on the thermoplastic resin film of the stencil sheet M. After this is done, the cutter unit cuts one stencil sheet M away from the rolled stencil sheet, the thus-prepared stencil sheet M being then conveyed to the printing section 3.

The printing section 3 has a printing drum 12 has a cylindrically formed porous ink-permeable peripheral wall made of an ink-permeable material such as a porous metal sheet or mesh, an ink-supplying device 15 formed by a squeegee roller 13 and a doctor roller 14 disposed inside the printing drum 12, and a pressure roller 16 that can approach and move away from the printing drum 12. The printing drum 12 is rotationally driving about its center by a rotational drive mechanism, under the control of the controller 28.

Figure 2:
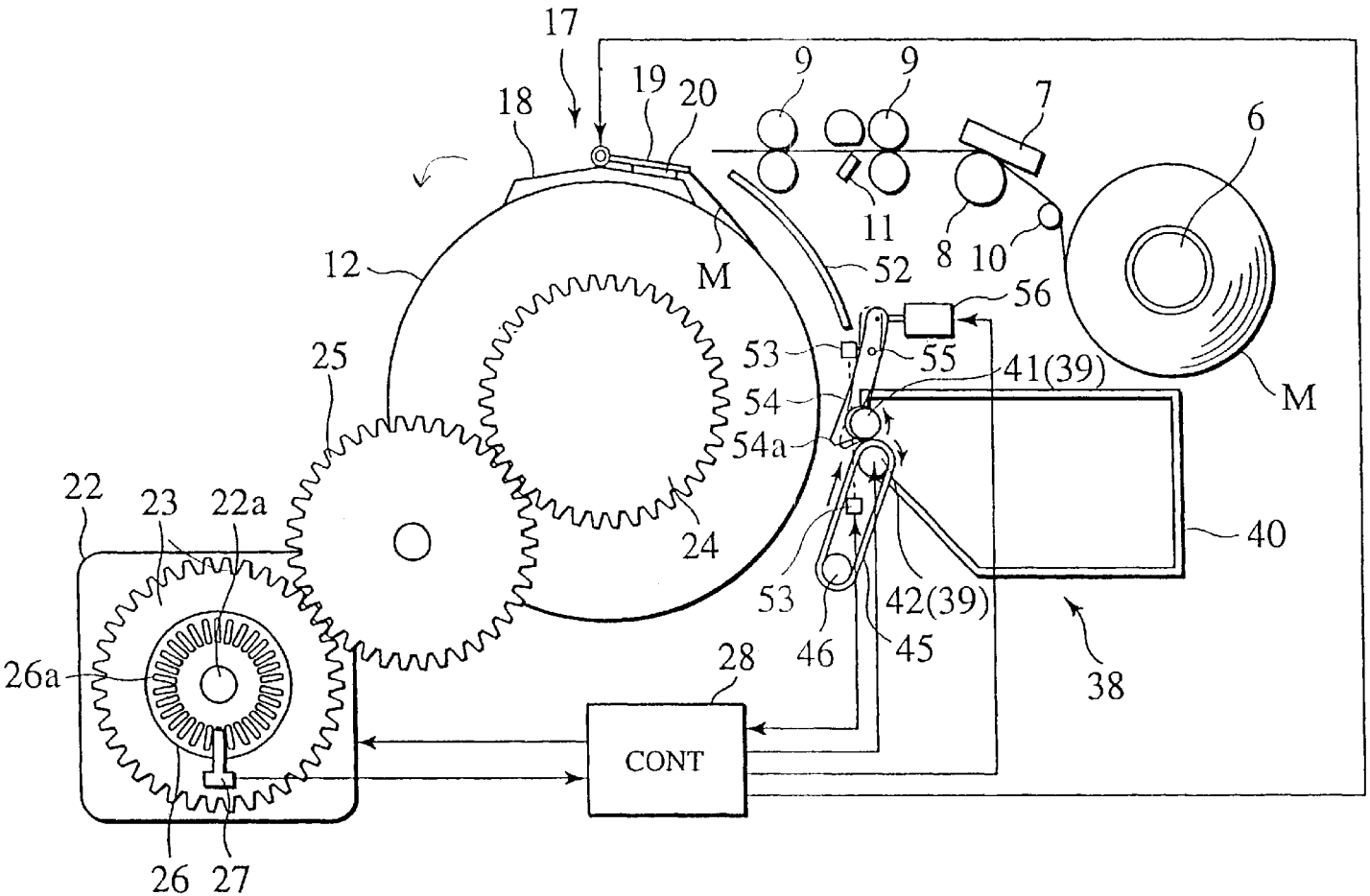
FIG. 2 is a side view showing the configuration in the area around the stencil disposal unit according to the embodiment.
Figure 3:
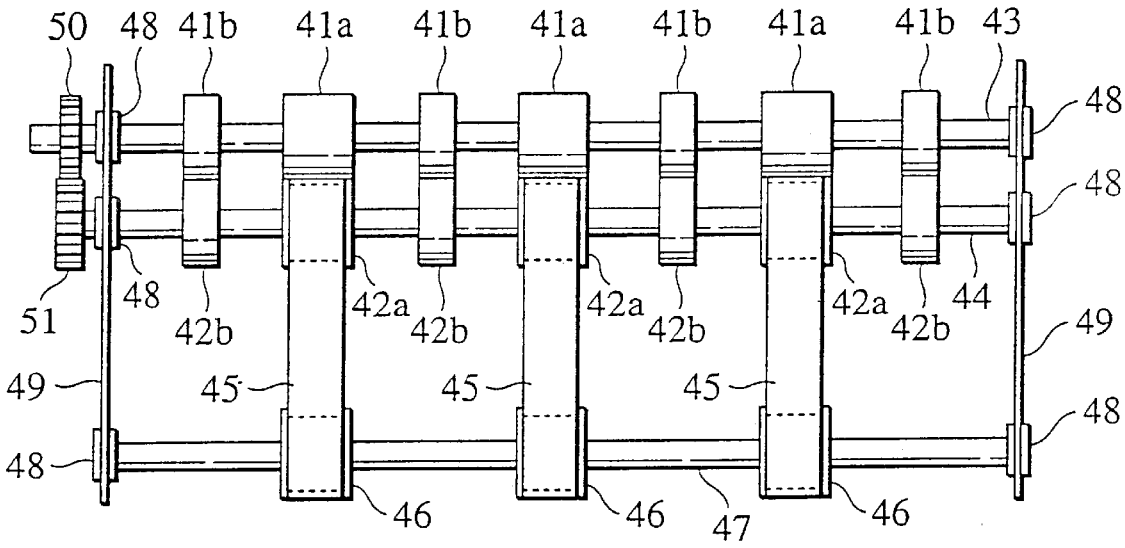
FIG. 3 is a front view showing a part of the configuration of the stencil disposal unit according to the embodiment.

The printing drum 12 is provided with a clamping device 17, which clamps the end part of the stencil sheet M. The clamping device 17 is controlled by the controller 28 and, as shown in FIG. 2, has a stencil clamping base 18 that protrudes from a part of the outer peripheral surface of the printing drum 12. The stencil clamping base 18 is provided with a clamping plate 19 that is supported so as to be rotatable about a pivot point substantially in parallel with the rotational axis of the printing drum 12. A magnet 20 that pulls in the clamping plate 19 is provided on the upper surface of the stencil clamping base 18.

The end part of a stencil sheet M that is conveyed from the stencil making section 2 to the printing section 3 is grabbed by the clamping plate 19, which is pulled by the magnet 20. The printing drum 12 rotates in the counterclockwise direction shown in FIG. 1 an FIG. 2, that is, in the direction along the direction in which the stencil sheet M end is fed in, and the stencil sheet M is wound around and attached to the peripheral wall surface of the printing drum 12. When this is done, the ink permeable porous sheet side of the stencil sheet M comes into contact with the printing drum 12.

As shown in FIG. 2, the rotational drive mechanism that rotationally drives the printing drum 12 is formed by a drive motor 22 and a gear train that transmits rotation of the drive motor 22 to the printing drum 12. The gear train has a driving gear 23 fixed to a rotating shaft 22*a* of the driver motor 22, a driven gear 24 provided on the printing drum 12, and an intermediate gear 25 that meshes with both the driving gear 23 and the driven gear 24. The printing drum 12, therefore, by the forward and reverse rotation of the drive motor 22, is caused to rotate in the forward and reverse directions vi the above-noted gear train.

The rotational condition of the drive motor 22 is detected by a rotation detection section, which as shown in FIG. 2, is formed by a slit plate 26 fixed to the rotational shaft 22*a* of the drive motor 22 and which rotates in concert therewith, and a detector 27 disposed on the motor 22, for example, in opposition with the slit plate 26.

The slit plate 26 has a plurality of open slits 26*a* arranged in a radial pattern in the rotation direction about the center of the rotational shaft 22*a*. The detector 27 is formed by a light source/sensor pair, which outputs a pulse signal responsive to the passage and blockage of light at the slit parts 26*a*. This signal is used to detect the rotational condition of the drive motor 22. The detection signal of the detector 27 is output to the controller 28, which controls the drive motor 22, processing being performed based on a count of the pulses of this signal.

Specifically, the pulse signal of the rotational drive mechanism is continuously input at an interval corresponding to the detection period (frequency) of the slits 26*a*, and counted by the controller 28. At the controller 28, a detection signal from a reference position detector (not shown in the drawing) is also input. The reference position detector detects each time the printing drum 12 reaches a reference position, at which point it outputs a reset signal. At the controller 28, the input of this reset signal resets the count value, at which point the rotational angle of the printing drum 12 is output. Thus, the controller 28 calculates the rotational angle of the printing drum 12 from the reference position.

The reference position of the printing drum 12 in this embodiment is a position where the clamping device 17 is precisely above, as shown in FIG. 2, this being the position at which the end part of a stencil sheet M transported from the stencil making section 2 is grabbed by the clamping device 17, and the position at which the clamping device 17 releases the end part of a stencil sheet M after completion of printing.

As shown in FIG. 1, a paper feed section 30 is provided at one end of the printing section 3 (left side in FIG. 1), and a paper discharging section 31 is provided at the other end of the printing section 3 (right side in FIG. 1).

The paper feed section 30 has a paper feeding tray 32 into which print paper P is stacked, a pick-up roller 33 that feeds print paper P from the paper feeding tray 32 one sheet at a time, and a paper feed timing roller 34 disposed between the printing drum 12 that prints onto the print paper P and the pressure roller 16.

The paper discharging section 31 has a grabbing claw 35 that peels the print paper P from the printing drum 12, a paper disposal feed belt 36, and a paper receiving tray 37 into which printed print papers P are stacked.

When printing is done, printing ink of a predetermined color is supplied to the inner peripheral surface of the printing drum 12 by the ink supplying device 15. The printing drum 12 rotates in the counterclockwise direction in FIG. 1 and FIG. 2, about its own center axis, by means of the rotational drive mechanism. The print paper P moves from left to right in FIG. 1, by the paper feed timing roller 34, in accordance with a predetermined timing in synchronization with the rotation of the printing drum 12, and is fed between the printing drum 12 and the pressure roller 16. The pressure roller 16 presses the print paper P up against the stencil sheet M that is wound around the outer peripheral surface of the printing drum 12, so that stencil printing is done onto the print paper P with ink of the predetermined color.

In this rotary stencil printing machine, a stencil disposal unit 38 which peels a used stencil sheet M from the printing drum 12 and disposes of it after printing is completed is provided on one side of the printing section 3 (right side in FIG. 1). This stencil disposal unit 38 is controlled by the controller 28 as described below, and is chiefly formed by stencil disposal rollers 39 and a stencil disposal container 40. The controller of the stencil disposal unit 38, of course, can be provided separately from the controller of the rotational drive mechanism 28 and the clamping device 17.

The stencil disposal rollers 39 are disposed in an area around the printing drum 12, at a location which avoids a location above the clamping device 17 when the printing drum 12 is at the above-noted reference position. The stencil disposal rollers 39 form a pair of rollers in mutual contact as they rotate in mutually opposite directions, and constitute the upper and lower stencil disposal rollers 41 and 42.

In this embodiment, a plurality of pairs of upper and lower stencil disposal rollers 41 and 42 are provided, separated from one another on supporting shafts 43 and 44 that are substantially parallel to the center axis of the printing drum 12. Of the plurality of upper and lower stencil disposal rollers 41 and 42, some upper and lower stencil disposal rollers 41*a* and 42*a* are formed so as to have a larger width than other upper and lower stencil disposal rollers 41*b* and 42*b*, an endless guide belt 45 being wound around the wider lower stencil disposal rollers 42*a*. The lower stencil disposal rollers 42*a* have grooves of a depth corresponding to the thickness of the guide belt 45 formed in the center thereof in the width direction. The guide belt 45 engages in this groove, and at a position of contact of the upper stencil disposal roller 41*a* and the lower stencil disposal roller 42*a*, the surface of both the lower stencil disposal roller 42*a* and the guide belt 45 are continuous and smooth.

The guide belt 45 is wound on a pulley 46 that serves as a rotational element positioned at a distance from the lower stencil disposal roller 41*a*. The pulley 46, in the same manner as the corresponding lower stencil disposal roller 42*a*, has a groove of a depth corresponding to the thickness of the guide belt 45 and receives the guide belt 45 therein. The pulley 46 is fixed to a shaft 47 that is parallel to the supporting shafts 43 and 44.

The supporting shafts 43 and 44 and the shaft 47 are rotatably mounted by the two ends thereof to two side plates 49 within the rotary stencil printing machine, via bearings 48 located at both ends. Mutually meshing gears 50 and 51 are provided on one end of the supporting shafts 43 and 44. One of the gears 50 and 51 is rotationally driven by a drive mechanism (not shown in the drawing). This rotational drive mechanism is controlled by the controller 28. By the rotational drive from the rotational drive mechanism, the supporting shafts 43 and 44, as shown by the arrow in FIG. 2, come into contact with the upper and lower stencil disposal rollers 41 and 42 and rotate them in mutually opposing directions. The guide belts 45, by the rotation of the lower stencil disposal rollers 42*a*, are driven in the direction of the arrow in FIG. 2.

The stencil disposal container 40 is formed as a box disposed to the rear of the rotational direction of the stencil disposal rollers 39 (upper and lower stencil disposal rollers 41 and 42).

The stencil disposal unit 38 also has a guide plate 52, disposed in the area around the periphery of the printing drum 12, this being provided between the above-described reference position of the printing drum 12 and the position of the stencil disposal rollers 39 in the opposite direction when the stencil sheet M is being attached and printing is being done.

The stencil disposal unit 38 also has a stencil disposal sensor 53, which has a light emitter and a light receiver, light between the light emitter and light receiver being emitted to and received from the part of the printing drum 12 in contact with the upper and lower stencil disposal rollers 41 and 42.

The stencil disposal unit 38 further has a peeling claw 54 provided so that it can swing about the pivot shaft 55 that is fixed in proximity to the upper stencil disposal roller 41. The swing action of the peeling claw 54 is driven by a solenoid 56. The end 54*a* of the peeling claw 54 driven by the solenoid 56 moves between a peeling position by protruding outwardly toward the printing drum 12 and a retracted position by retracting toward the upper stencil disposal roller 41.

Next, the stencil disposal operation in the stencil disposal unit 38 configured as described above is described in detail below.

Figure 4:
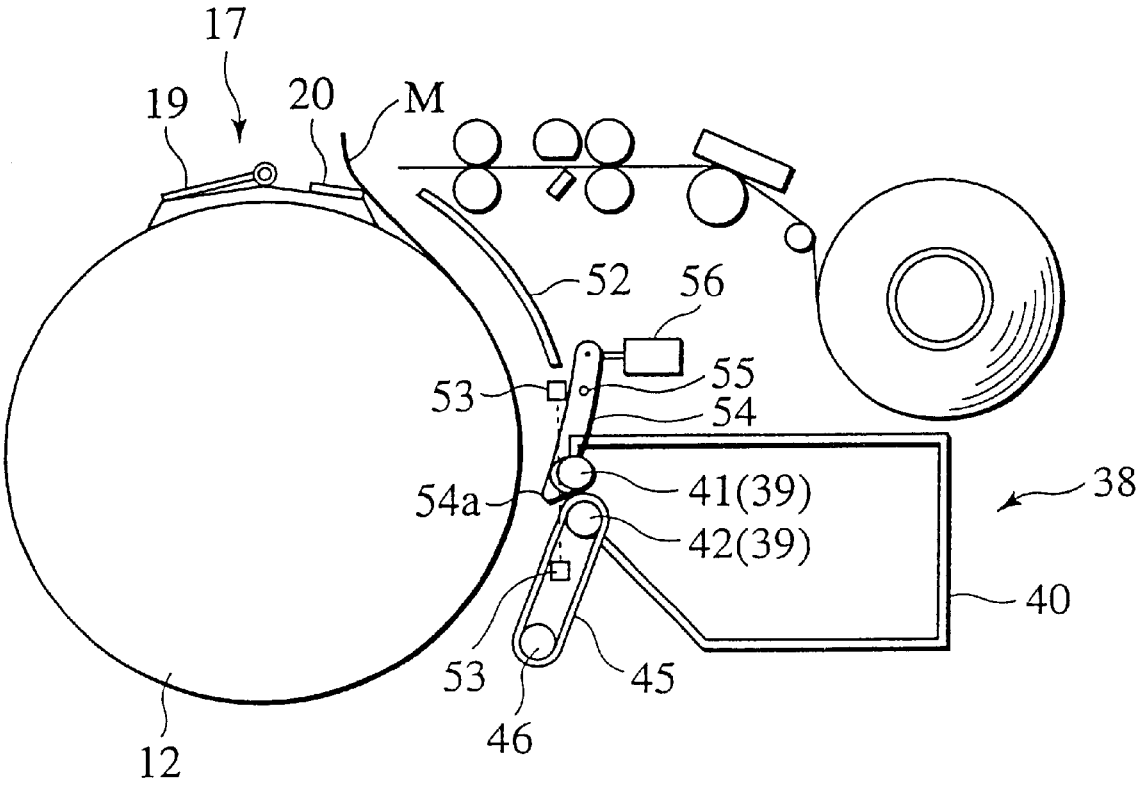
FIG. 4 through FIG. 7 are side views showing the sequence operation of stencil sheet disposal in the stencil disposal unit according to the embodiment.

First, after the above-noted print is completed, as shown in FIG. 4, with the printing drum 12 at the reference position, the clamping plate 19 is caused to swing, so as to release the end part of the used stencil sheet M that the clamping plate 19 is clamping. At this point, assume that the end of the released stencil sheet M, similar to the case studied in the past, has a curl in the direction away from the printing drum 12.

Figure 5:
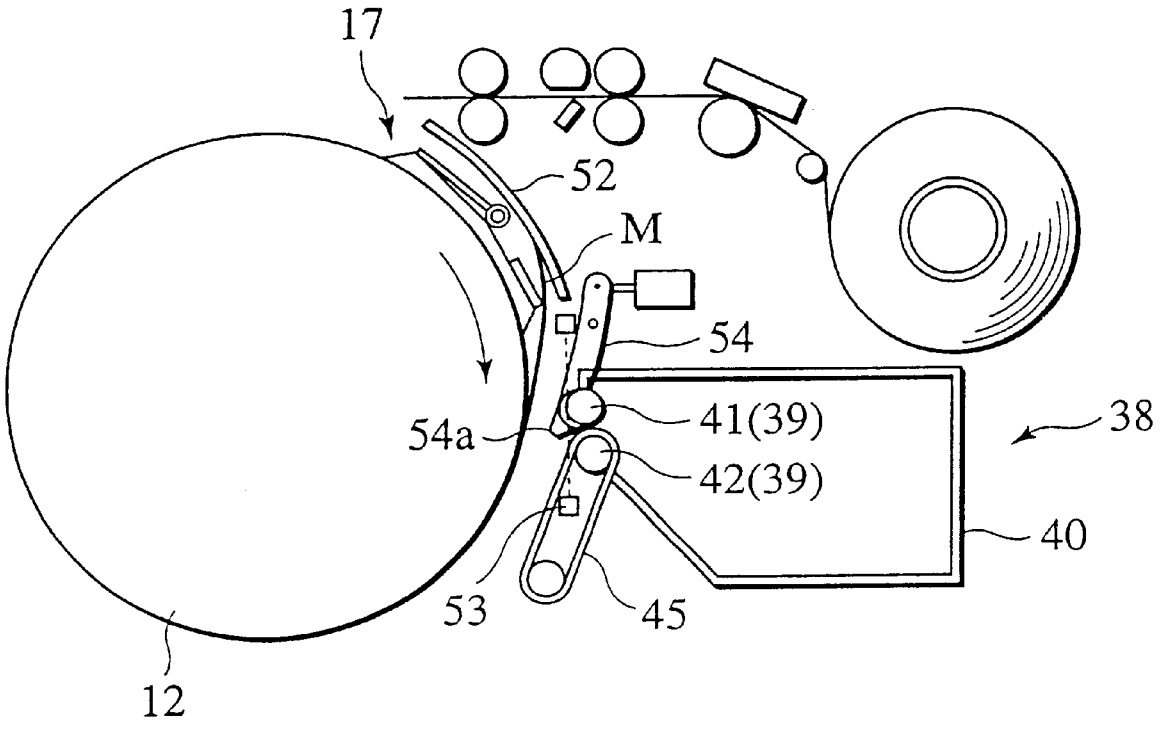

Next, as shown in FIG. 5, the printing drum 12 is caused to rotate in a direction that is the opposite from the direction during attachment of the stencil sheet M and printing therewith, this being the clockwise direction in FIG. 5. By doing this, the stencil sheet M attached to the printing drum 12 is rotated and moved from its freed-up end in the direction of the printing drum 12. When this is done, the stencil sheet M receives resistance by the rotation of the printing drum 12 in the reserve direction so that the stencil sheet M moves closer to the printing drum 12. The curl at the end of the stencil sheet M, by the action of the reverse rotation of the printing drum 12, is prevented by the guide plate 52 from deflecting, up until the stencil disposal rollers 39.

Figure 6:
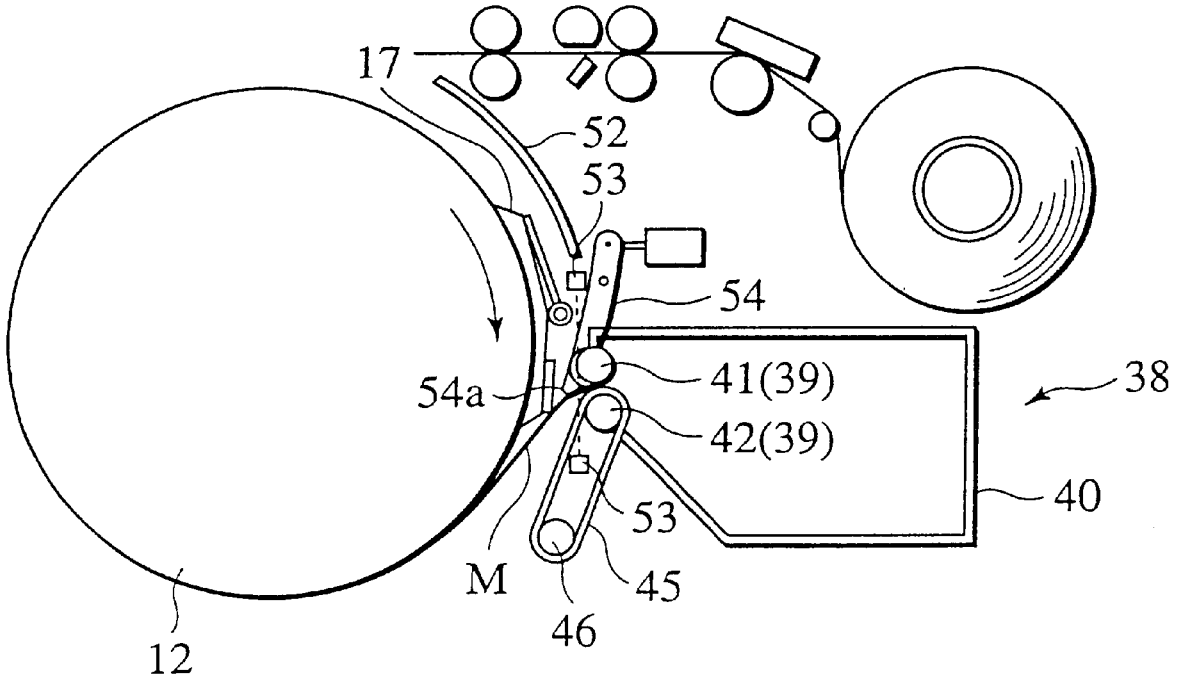

Next, as shown in FIG. 6, accompanying the reverse rotation of the printing drum 12, at the point at which the end part of the stencil sheet M moves up to the stencil disposal rollers 39, the clockwise rotation of the printing drum 12 is stopped. When this is done, the end part of the stencil sheet M, by the curl that has developed therein, attempts to enter between the upper and lower stencil disposal rollers 41 and 42. The fact that the end part of the stencil sheet M has moved as far as the stencil disposal rollers 39 is detected by the relationship between the rotational angle of the printing drum 12 from a reference position calculated based on a count signal output to the controller 28 from the rotational detector formed by the slit plate 26 and the detector 27 and the pre-established position of the stencil disposal rollers 39. The fact that the end part of the stencil sheet M has reached the stencil disposal rollers 39 can also be detected from the blocking of light between the light emitter and light receiver of the stencil disposal sensor 53 by the end part of the stencil sheet M.

Figure 7:
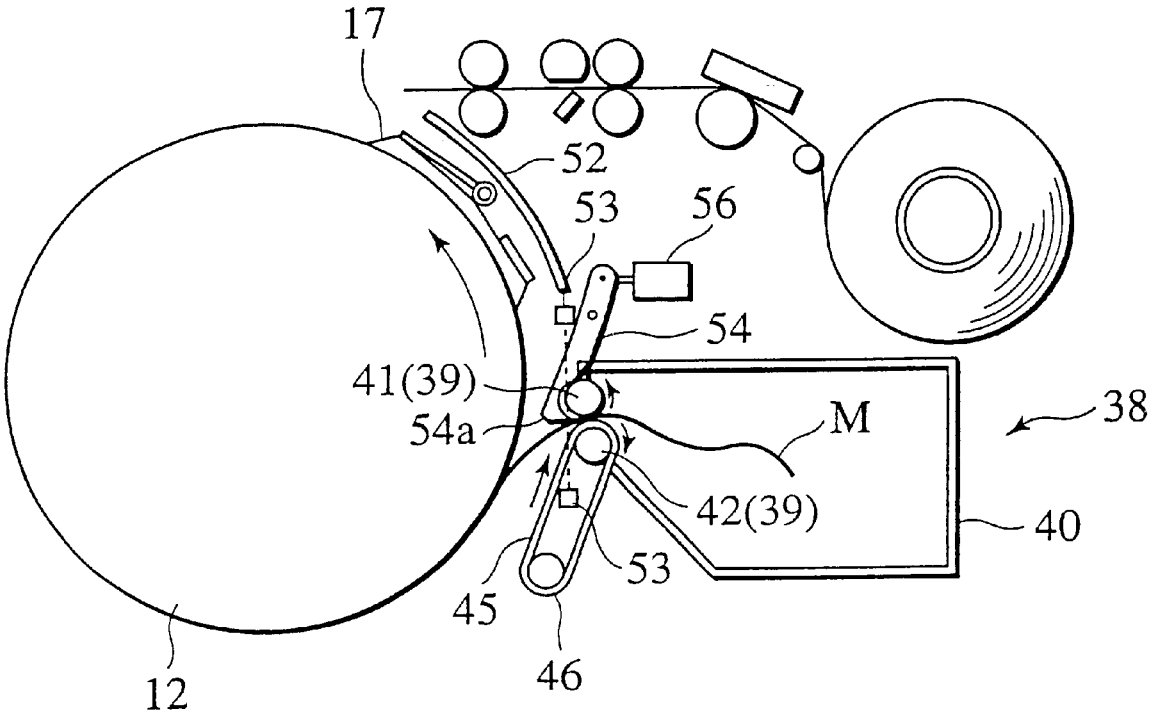
Figure 8:
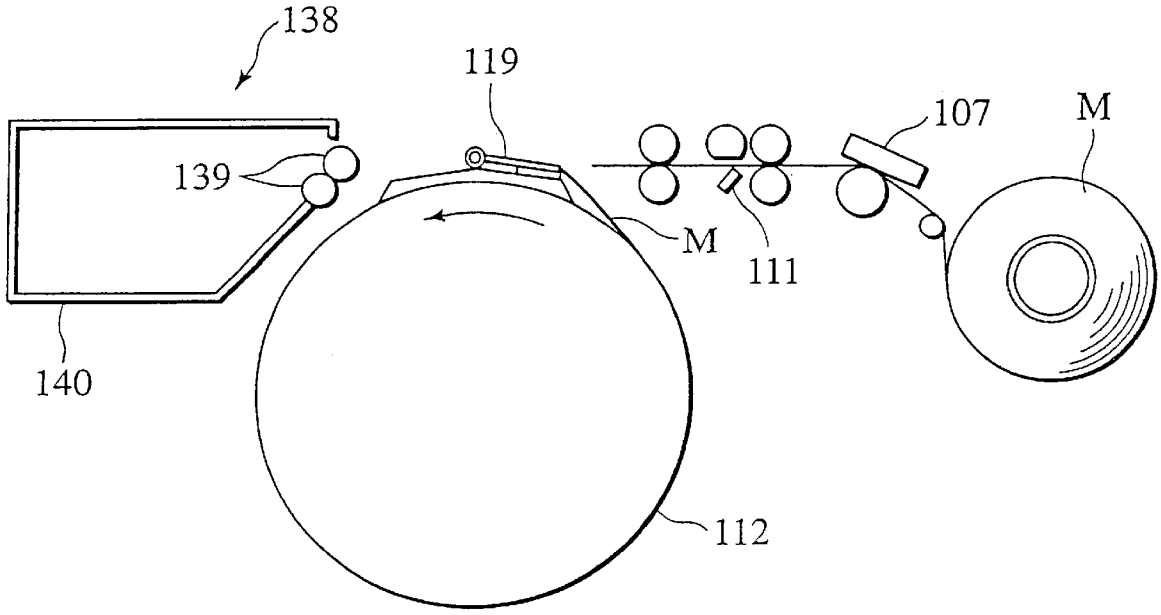
FIG.8 (PRIOR ART)
FIG. 8 is a side view showing a part of the configuration of a rotary stencil printing machine to which a stencil disposal unit studied by the inventors of the present invention is applied.
Figure 9:
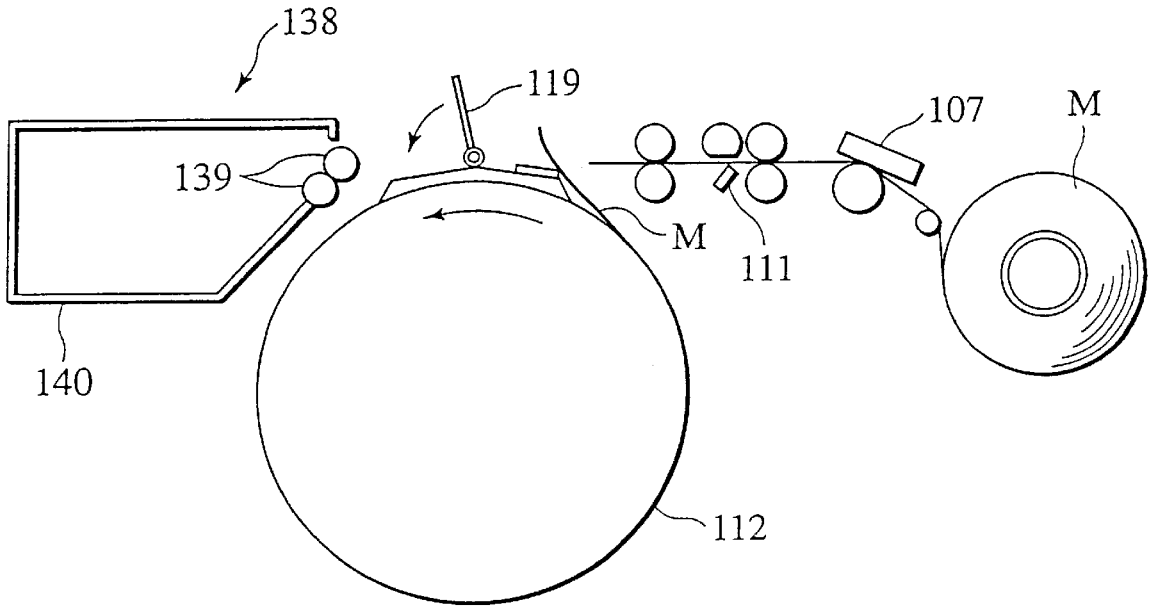
FIG.9 (PRIOR ART)
FIG. 9 and FIG. 10 are side views showing the stencil sheet disposal operation of the stencil disposal unit studied by the inventors.
Figure 10:
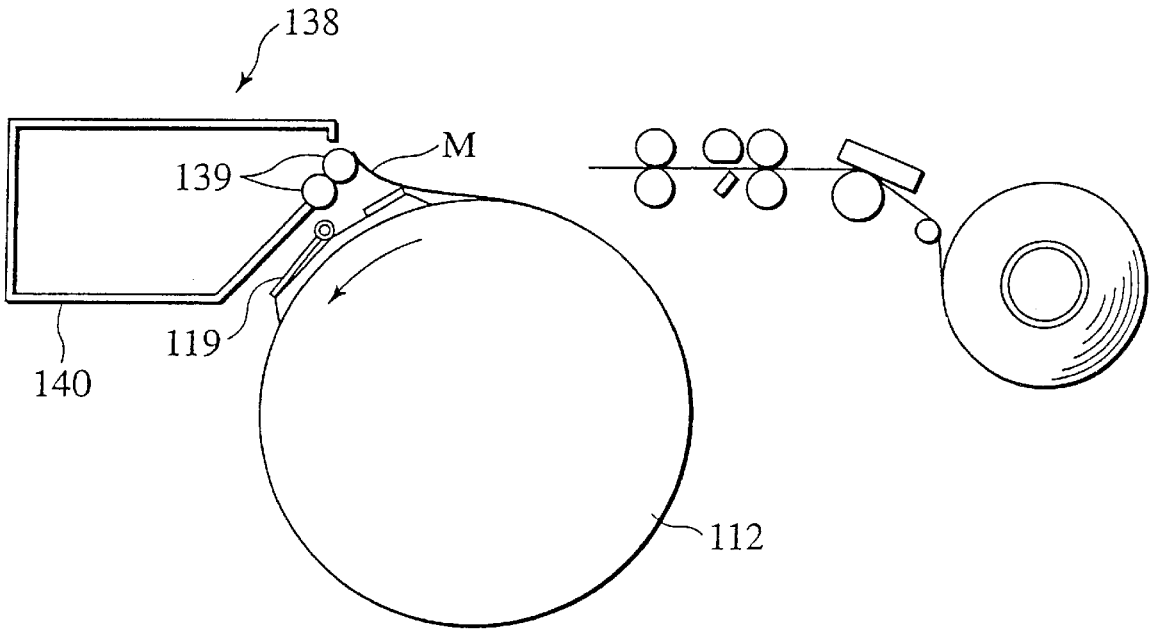
FIG.10 (PRIOR ART)
Figure 11:
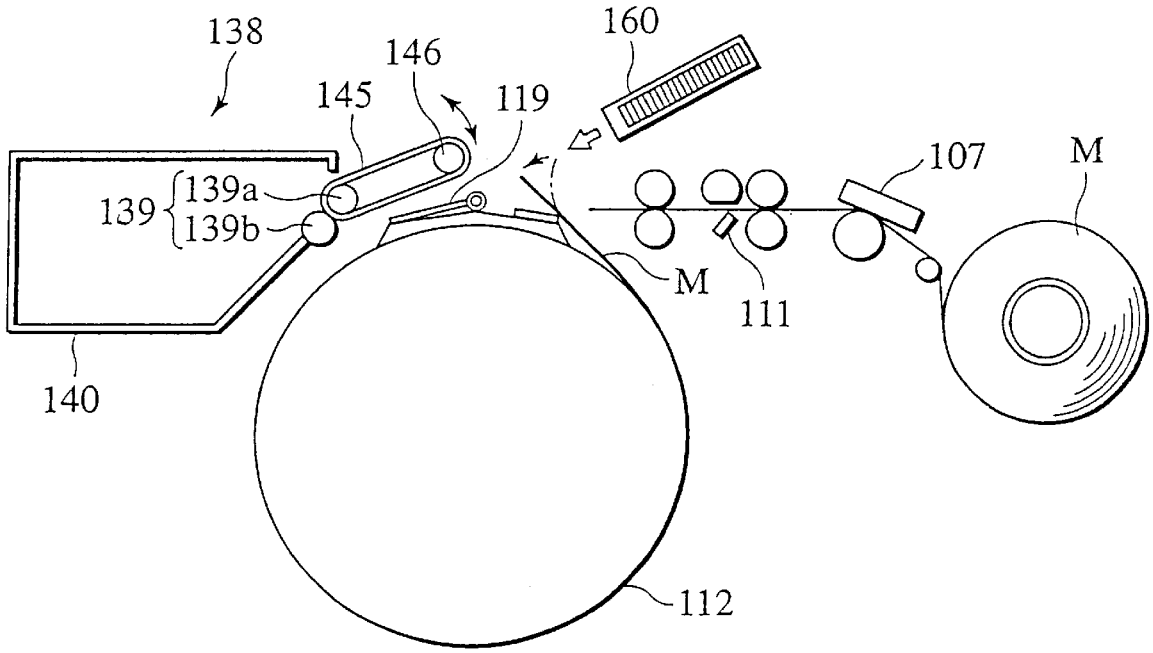
FIG.11 (PRIOR ART)
FIG. 11 is a side view showing a stencil disposal unit which is the object of further study by the inventors.

Next, as shown in FIG. 7, the printing drum 12 is caused to rotate in the same direction as when the stencil sheet M is attached and when printing is done, this being the counterclockwise direction in FIG. 7. When this is done, the upper and lower stencil disposal rollers 41 and 42 are rotationally driven as described above (direction of the arrow in FIG. 7). With the rotation of the lower stencil disposal roller 42*a*, the guide belt 45 is driven in the direction of the arrow of FIG. 7.

With counterclockwise rotation of the printing drum 12 and drive of the stencil disposal rollers 39 or the like, the used stencil sheet M is transported to within the stencil disposal container 40 and retrieved therein, this completing the disposal of the stencil sheet M. Whether the stencil sheet M has been transported and placed in stencil disposal container 40 is detected by the restoration of light emission and reception at the light emitter and light receiver of the stencil disposal sensor 53.

During the disposal operation of the stencil sheet M, after the end part of the stencil sheet M moves to the stencil disposal rollers 39, and up until the time when the stencil sheet M is transported to within the stencil disposal container 40 and retrieved therein, the end part 54*a* of the peeling claw 54 moves to the peeling position close to the printing drum 12. When this occurs, the end 54*a* of the peeling claw 54 peels away the stencil sheet M from the peripheral wall of the printing drum 12, and operates so as to guide the stencil sheet M between the upper and lower stencil disposal rollers 41 and 42 of the stencil disposal rollers 39. When the clamping device 17 passes the stencil disposal rollers 39 when disposing the stencil sheet M and in general with regard to the cases of attaching the stencil sheet M and performing printing, as shown in FIG. 4 to FIG. 6, the end part 54*a* moves to the retracted position by retracting towards the upper stencil disposal roller 41, so as to avoid contact with the clamping device 17.

Additionally, during the above-noted stencil disposal operation, the guide belt 45 acts so as to guide the stencil sheet M between the upper and lower stencil disposal rollers 41 and 42 of the stencil disposal rollers 39. Specifically, the printing drum 12 is caused to rotate in the clockwise direction, so that the end part of the stencil sheet M moves up to the stencil disposal rollers 39, at which point if the end part of the stencil sheet M misses the space between the upper and lower stencil disposal rollers 41 and 42, the end stencil sheet M is appropriately guided therebetween.

As described above, in a stencil disposal unit 38 according to an embodiment of the present invention, in order to dispose of a used stencil sheet M clamped at and wound around a printing drum 12, the clamp of the end part of the stencil sheet M is released, the printing drum 12 is caused to rotate in the clockwise direction, which is the direction in which the stencil sheet M with the freed-up end is wound onto the printing drum 12, the freed-up end of the stencil sheet M is guided to a position at which it is to be pulled in by the stencil disposal rollers 39, and the printing drum 12 is then rotated in the direction that is the opposite of the direction of winding the stencil sheet M.

That is, in the stencil disposal unit 38, because the end part of the stencil sheet M is released from the clamped condition, the printing drum 12 is caused to rotate in the direction of winding the stencil sheet M, and the end of the stencil sheet M is fed up to the stencil disposal rollers 39, from which point the printing drum 12 is caused to rotate in the direction opposite the winding direction, the resistance is received such that causes the curl that develops in the end part of the stencil sheet M to move toward the printing drum 12 as it is fed to the stencil disposal rollers 39, thereby preventing faulty disposal operation due to the curl.

Also, because the released end of the stencil sheet M moves toward the stencil disposal rollers 39 in a condition in which resistance is received so that the curl at the end part of the stencil sheet M moves toward the printing drum 12, unlike in past, in which the configuration of the printing drum such as the clamping device is restricted on the layout, it is possible to have a layout of the stencil disposal unit 38 with a high degree of freedom.

Additionally, it is not necessary to provide a additional moving mechanism (such as a guide belt moving mechanism or air blower as used in the past) in order to guide the curl that develops in the stencil sheet M to the stencil disposal rollers 39, thereby enabling a simple configuration.

By adopting the guide plate 52, when the printing drum 12 is rotated in the direction of winding of the stencil sheet M, it is possible to hold the curled end of the stencil sheet M so that it does not deflect until it reaches the stencil disposal rollers 39, thereby enabling more reliable operation.

By adopting the guide belt 45, it is possible to appropriately guide the stencil sheet M to between the stencil disposal rollers 39, thereby enabling more reliable operation.

By adopting the stencil disposal sensor 53, it is possible to detect that the stencil sheet M has be transported up to the stencil disposal rollers 39, and to detect whether or not the stencil sheet M has been transported to a predetermined pull-in position, thereby enabling more reliable operation.

Although, in this embodiment, the stencil disposal unit 38 is adopted in a rotary stencil printing machine in which the end of a stencil sheet M serving as one master and fed by the stencil making section 2 is clamped, and the printing drum 12 is rotated in the direction in which the stencil sheet M is fed in, the stencil sheet M being then attached, it will be readily understood that the present invention is not restricted to this application.

For example, it is alternately possible apply the present invention to a rotary stencil printing machine in which the rear end of a stencil sheet M serving as one master and fed by the stencil making section 2 is clamped, and the printing drum 12 is rotated in the direction in which the stencil sheet M is fed in, the stencil sheet M being then attached.

Additionally, the present invention can be applied to a rotary stencil printing machine in which both ends of a stencil sheet M serving as one master is clamped at the printing drum 12. In a case in which both ends of the stencil sheet M are clamped, the clamp at either end is released, thereby enabling disposal from the released end, as described above.

Although this embodiment of the present invention is described for the example of a rotary stencil printing machine, in which a printing section 3 has a pressure roller 16 that approaches and moves away from the printing drum 12 so as to perform printing, it will be readily understood that the present invention is not restricted in this manner.

For example, the present invention can also be applied to a rotary stencil printing machine having an inner pressure roller that pressing an ink-permeable peripheral wall within the printing drum 12, and which has, instead of a movable pressure roller 16, a pressure drum that rotates in synchronization with the printing drum 12 at the printing drum 12.

Although the invention has been described above by reference to a certain embodiment of the invention, the invention is not limited to the embodiment described above. Modifications and variations of the embodiment described above will occur to those skilled in the art, in light of the teachings. The scope of the invention is defined with reference to the following claims.

What is claimed is:

1. A stencil disposal unit disposing a stencil sheet an end part of which is clamped at and wound onto a printing drum of a rotary stencil printing machine comprising:

a rotational drive mechanism capable of causing the printing drum to rotate in a winding direction with respect to an end part of a stencil sheet released from a clamp and in a reverse direction opposite to the winding direction, a pair of stencil disposal rollers arranged in an area around a periphery of the printing drum and rotatable respectively in opposite directions in mutual contact with each other, thereby pulling in the end part of the stencil sheet so as to transport the stencil sheet to a predetermined disposal position, wherein by rotating the printing drum through a predetermined angle in the winding direction, the end part of the stencil sheet is guided to a pull-in position at which the stencil sheet is to be pulled in, and as the printing drum is rotated in the reverse direction, the stencil sheet is pulled in at the pull-in position by the pair of disposal rollers.

2. A stencil disposal unit according to claim 1, further comprising a controller reversibly controlling rotation of the rotational drive mechanism so that, after the printing drum is caused to rotate through the predetermined angle in the winding direction and the end part of the stencil sheet is guided to the pull-in position, the printing drum is caused to rotate in the reverse direction, while the stencil sheet is pulled in by the pair of stencil disposal rollers.

3. A stencil disposal unit according to claim 1, further comprising a guide member arranged along and around a periphery of the printing drum, so as to be located between a position at which a clamp of an end part of the stencil sheet is released and that at which the pair of stencil disposal rollers are arranged.

4. A stencil disposal unit according to claim 1, further comprising an endless guide belt wound between one of the pair of stencil disposal rollers and a rotational element having an axis parallel to a rotational axis of one of the pair of stencil disposal rollers, and rotationally driven in accordance with a rotation of the one of the pair of stencil disposal rollers.

5. A stencil disposal unit according to claim 4, wherein the rotational element has a rotational axis parallel to the rotational axis of the one of the pair of stencil disposal rollers.

6. A stencil disposal unit according to claim 1, further comprising a detector detecting an end part of a stencil sheet guided to the pull-in position by use of a rotation of the printing drum.

7. A stencil disposal unit according to claim 1, further comprising a peeling claw peeling from the printing drum a stencil sheet being guided to the pull-in position by use of a rotation of the printing drum.

8. A stencil disposal unit according to claim 1, wherein an end part of the stencil sheet guided to the pull-in position by use of a rotation of the printing drum curls in a direction directing away from the printing drum.

9. A stencil disposal unit for a rotary stencil printing machine having a rotational drive capable of rotating a printing drum in a first, forward stencil loading and printing direction and a second, reverse direction opposite the first direction, a leading edge of a stencil sheet being releasably secured to the printing drum, the stencil sheet being wound onto an outer surface of the printing drum by a rotation of the printing drum in the first direction, said stencil disposal unit comprising:

a pair of stencil disposal rollers arranged in an area around a periphery of the printing drum and rotatable respectively in opposite directions in mutual contact with each other and that can pull in the leading edge of the stencil sheet so as to transport the stencil sheet to a predetermined disposal position, said stencil disposal rollers being angularly displaced about an axis of the printing drum through a predetermined angle in the second direction relative to a reference position at which the leading edge of the stencil sheet is engaged to and disengaged from the printing drum;

wherein by a rotation of the printing drum through a predetermined angle in the second direction, the leading edge of the stencil sheet is guided to a pull-in position, and wherein during a further rotation of the printing drum in the first direction the stencil sheet is pulled by said pair of stencil disposal rollers and transported to the disposal position.

* * * * *